US007720422B2

(12) United States Patent
Son et al.

(10) Patent No.: US 7,720,422 B2
(45) Date of Patent: May 18, 2010

(54) FUSER CLEANING APPARATUS AND METHOD OF OPERATING A FUSER CLEANING DEVICE FOR USE WITH AN IMAGE FORMING DEVICE

(75) Inventors: Jung Woo Son, Seoul (KR); Soo Cheol Park, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 199 days.

(21) Appl. No.: 11/859,284

(22) Filed: Sep. 21, 2007

(65) Prior Publication Data

US 2008/0138127 A1 Jun. 12, 2008

(30) Foreign Application Priority Data

Dec. 7, 2006 (KR) ..... 10-2006-0123933

(51) Int. Cl.
*G03G 15/20* (2006.01)

(52) U.S. Cl. ..... 399/327

(58) Field of Classification Search ..... 399/323, 399/327

See application file for complete search history.

(56) References Cited

U.S. PATENT DOCUMENTS

| | | | | |
|---|---|---|---|---|
| 5,043,595 | A * | 8/1991 | Sugiyama | 307/39 |
| 6,094,559 | A * | 7/2000 | Otsuka et al. | 399/327 |
| 6,845,225 | B2 * | 1/2005 | Toyoda et al. | 399/327 |
| 2006/0159479 | A1 * | 7/2006 | Sugita et al. | 399/69 |

FOREIGN PATENT DOCUMENTS

| | | |
|---|---|---|
| JP | 2004-309568 | 11/2004 |

* cited by examiner

*Primary Examiner*—David M Gray
*Assistant Examiner*—Andrew V Do
(74) *Attorney, Agent, or Firm*—Staas & Halsey LLP

(57) ABSTRACT

A fuser cleaning apparatus and method of operating a fuser cleaning apparatus for use with an image forming device. Heat is efficiently transferred to a guide member of a fuser, thereby allowing for relatively easy performance of a cleaning operation of the fuser, since a heating roller of the fuser is heated by a heater while the heating roller is not in motion. It is also possible to prevent melted toner remnants from contaminating the heating roller since a sheet of paper which has waited at an entrance of the fuser is conveyed and passed between the heating and pressure rollers of the fuser after the heating roller is heated while it is not in motion.

15 Claims, 13 Drawing Sheets

FUSER CLEANING APPARATUS AND METHOD OF OPERATING A FUSER CLEANING DEVICE FOR USE WITH AN IMAGE FORMING DEVICE

CROSS-REFERENCE TO RELATED APPLICATION

This application claims the benefit of Korean Patent Application No. 2006-123933, filed Dec. 7, 2006, in the Korean Intellectual Property Office, the disclosure of which is incorporated herein by reference.

BACKGROUND OF THE INVENTION

1. Field of the Invention

Aspects of the present invention relate to a fuser cleaning apparatus and a method of operating a fuser cleaning apparatus for use with an image forming device, in which a contaminated fuser of the image forming device is cleaned by a heating of a heating roller of the fuser while the heating roller is not in motion.

2. Description of the Related Art

In an electro-photographic image forming device, a latent image is formed on a photosensitive drum to which toner is adhered. The toner is developed into a visible image using developer and the visible toner image is then transferred to a print medium, such as paper or a transparency. The image transferred to the print medium is fixed to the print medium by passing the print medium through a fuser. Once the print medium has passed through the fuser, the print medium is discharged from the image forming apparatus.

The fuser applies heat and pressure to the print medium to fix the image to the print medium. To this end, the fuser includes a heating roller to apply heat to the print medium and a pressure roller to apply pressure to the print medium. The heating roller and the pressure roller are provided along a conveyance path of the print medium.

As a result, it is frequently necessary to clean a fuser that becomes contaminated with toner. According to a conventional method of cleaning a fuser, a fusing temperature of the fuser is set to a high preset temperature in a cleaning mode via a heating of the heating roller while rotating the heating and pressure rollers. When the fusing temperature reaches the preset temperature, the medium (i.e., a sheet of paper) is picked up and passed between the heating and pressure rollers to remove melted toner.

The fuser further includes a guide member, which is referred to as a claw, to smoothly discharge media while preventing them from being wound around the photosensitive drum. As the number of sheets of media printed on increases, an increasing amount of toner that attaches to the guide member ends up being fixed to the guide member due to the fusing temperature increases during fusing processes. However, according to the conventional cleaning method, melting toner contaminants on the guide member is difficult since the cleaning operation is performed while the heating roller rotates. Rather, toner contaminants on the heating and pressure rollers may be added to toner contaminants on the guide member.

Thus, the conventional cleaning method is not effective to clean contaminants on the guide member. If the contaminants fixed to the guide member scratch a medium to be discharged, undesired vertical black lines may be printed on the medium and the medium may also be jammed.

SUMMARY OF THE INVENTION

Therefore, it is an aspect of the invention to provide a fuser cleaning apparatus and a method of operating a fuser cleaning apparatus for use with an image forming device in which media are prevented from being scratched and jammed during fusing processes due to residual contaminants on a guide member which are hard to clean.

In accordance with an aspect of the invention, there is provided a fuser cleaning apparatus, the apparatus comprising a fuser including a guide member to guide a print medium conveyed through the image forming device, and heating and pressure rollers to fix an image to the print medium; a power source to power the conveyance of the print medium and to rotate the fuser; a heater to heat the heating roller to melt contaminants fixed to the guide member; and a controller to drive the heater while the fuser is not rotated and to pass the print medium through the fuser to remove the melted contaminants from the guide member.

In accordance with an aspect of the invention, there is provided a fuser cleaning method for use with an image forming device comprising a fuser including a guide member and heating and pressure rollers to fix an image transferred to a print medium, the method comprising: heating the fuser, when a cleaning mode for the fuser has been set, by driving a heater thereof while the fuser does not rotate to melt contaminants on the guide member; and passing the print medium through the fuser to absorb and remove the melted contaminants.

In accordance with an aspect of the invention, there is provided a method of operating a cleaning mode of a fuser of an image forming apparatus, comprising: setting a fuser cleaning temperature; activating a power source of the image forming apparatus to convey the print medium through the apparatus to a first position; when the print medium reaches the predetermined position, deactivating the power source and activating a heater of the fuser to heat the fuser; when the temperature of the fuser reaches the fuser cleaning temperature, reactivating the power source to convey the print medium to a second position and deactivating the heater; and when the print medium reaches the second position, ending the cleaning mode.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
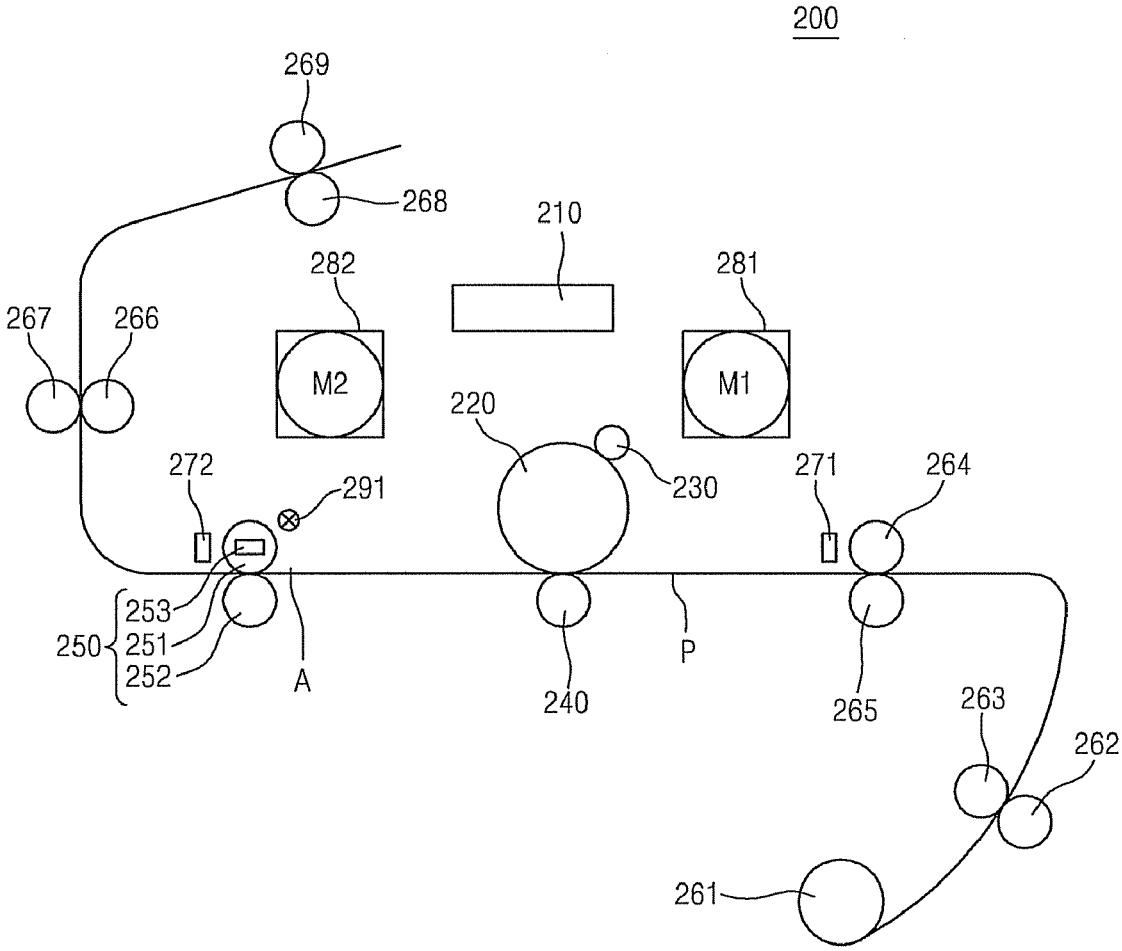
FIG. 1 is a schematic diagram of a fuser cleaning apparatus for an image forming device according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 is a schematic diagram of a fuser cleaning apparatus 200 for use with an image forming device according to an embodiment of the present invention. The fuser cleaning apparatus 200 includes an exposure device 210, a photosensitive drum 220, a developing roller 230, a transfer roller 240, a fuser 250, a pickup roller 261, a paper feed sensor 271, and first and second motors 281 and 282. The exposure device 210 generates a laser beam, which forms a latent electrostatic image on a surface of the photosensitive drum 220. The developing roller 230 causes toner to adhere to the photosensitive drum 220. The developing roller 230 also develops the latent electrostatic image formed on the photosensitive drum 220 into a toner image. The transfer roller 240 is provided under the photosensitive drum 220 to transfer the toner image formed on the photosensitive drum to a medium (i.e., paper, or transparencies, and hereinafter referred to as "paper").

The fuser 250 applies heat and pressure to the paper carrying the transferred toner image so as to fix the toner image to the paper. The fuser 250 includes a heating roller 251 to generate high heat and a pressure roller 252 that is in close contact with the heating roller 251. The heating roller 251 includes a heater 253 to generate the high heat. A heating lamp provided in the heating roller 251 or an electric heating coil inserted between inner and outer circumferential surfaces of the heating roller may be used as the heater 253. The fuser 250 also includes a temperature sensor 291 provided near the heating roller 251 to sense the temperature of the surface of the heating roller. The pressure roller 252 closely contacts the heating roller 251 at a constant pressure and rotates at the same speed as the heating roller 251.

The pickup roller 261 is provided at a beginning position of a paper conveyance path P to pick up each sheet of paper from a paper feed cassette (not shown) in which sheets of paper are stacked. The paper conveyance path P is a path along which the paper is conveyed until the paper is discharged through paper exit rollers 266, 267, 268, and 269 after being picked up by the pickup roller 261. Conveying rollers 262 and 263, which convey the picked-up sheet of paper, registration rollers 264 and 265, which align the front end of the sheet of paper that is being conveyed, the paper exit rollers 266, 267, 268, and 269, which discharge the sheet of paper, the photosensitive drum 220, the transfer roller 240, and the fuser 250 are provided along the paper conveyance path P.

The paper feed sensor 271 senses a sheet of paper that is being conveyed and is provided near the registration rollers 264 and 265 to sense that the sheet of paper is moving to the photosensitive drum 220. The paper feed sensor outputs a first sensed signal. The first sensed signal is used to determine exposure and developing timings.

A paper exit sensor 272 is provided in the paper conveyance path P downstream of the paper feed sensor 271, and, more specifically, downstream of the fuser 250. The paper exit sensor 272 senses a sheet of paper that passes through the fuser 250 and outputs a second sensed signal. The second sensed signal is used to determine the time to complete printing.

The first and second motors 281 and 282 respectively transfer motive force to the components. The first motor 281 is connected to the photosensitive drum 220 and the components (i.e., the developing roller 230, the transfer roller 240, the registration rollers 264 and 265, the conveying rollers 262 and 263, and the pickup roller 261) that are provided in the paper conveyance path P upstream of the photosensitive drum 220. The second motor 282 is a drive source to drive the components (i.e., the heating roller 251, the pressure roller 252, and the paper exit rollers 266, 267, 268, and 269) that are provided in the paper conveyance path P downstream of the photosensitive drum 220.

Figure 2:
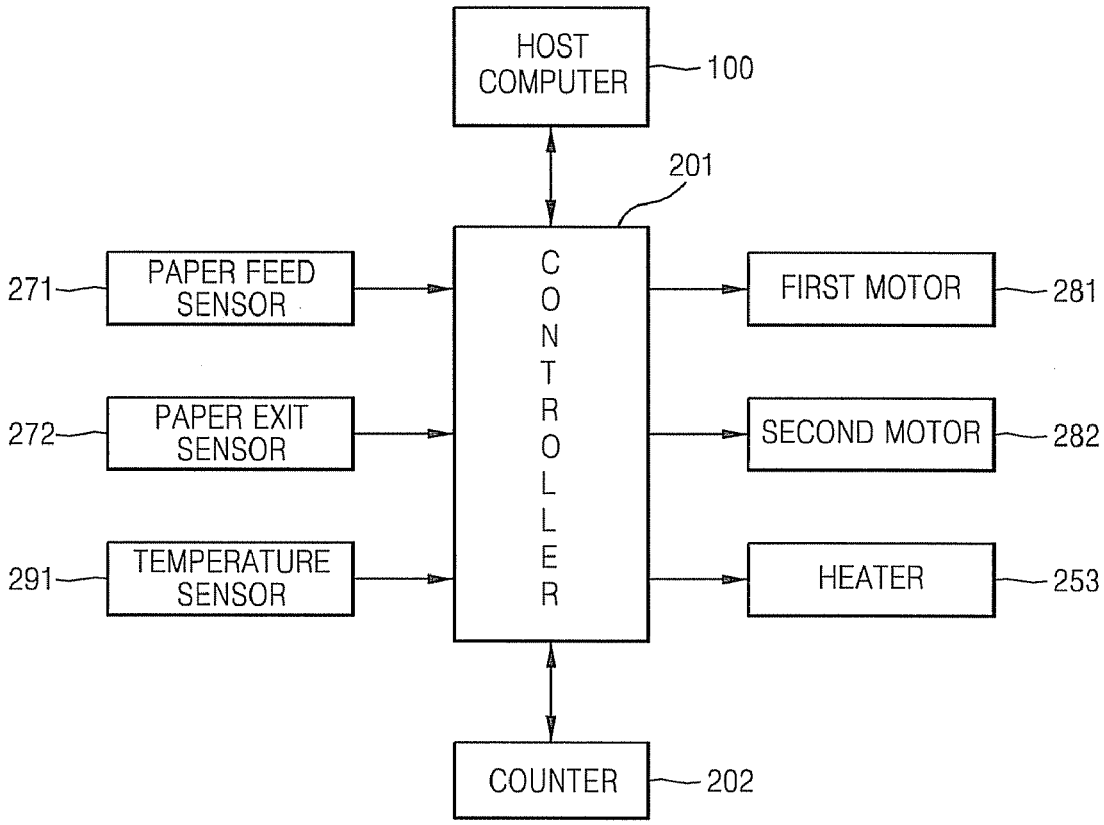
FIG. 2 is a control block diagram of a structure for controlling the cleaning apparatus of FIG. 1.

The fuser cleaning apparatus of the present invention includes a controller 201 to control overall operations of the fuser cleaning apparatus as shown in FIG. 2. The controller 201 receives a setting command input by the user from a host computer 100 and performs a printing operation.

Although fuser cleaning operations may be performed each time a printing operation is performed, it is more effective to perform fuser cleaning operations when a fuser cleaning mode has been set. The fuser cleaning mode may be set based on the type and size of the product and/or on the number of printed sheets of paper. Taking into consideration the fact that printing of tens of thousands of sheets severely contaminates a guide member of the fuser, the setting of the fuser cleaning mode on the number of printed sheets may be advantageous.

The fuser cleaning mode may be set directly by the user through the host computer 100 or may be automatically set when the total number of printed sheets of paper counted in printing operations reaches a preset number. When the fuser cleaning mode is automatically set, the controller 201 uses print count information that is obtained by counting, through a counter 202, the total number of sheets of paper printed in printing operations.

Figure 3:
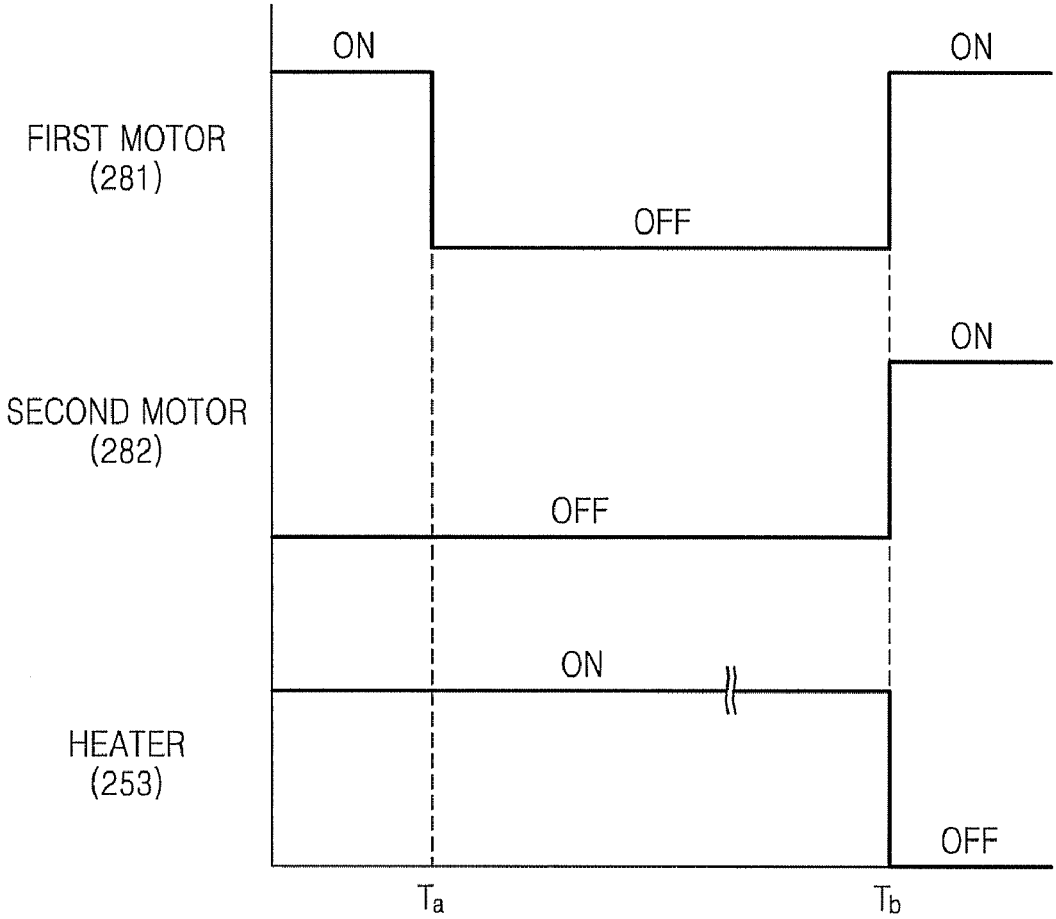
FIG. 3 illustrates operation control timings of first and second motors and a heater when performing a fuser cleaning operation according to an embodiment of the present invention.

FIG. 3 illustrates operation control timings of the first and second motors and the heater when performing a fuser cleaning operation according to the present invention, and FIGS. 4A to 4D illustrate fuser cleaning processes.

Figure 4A:
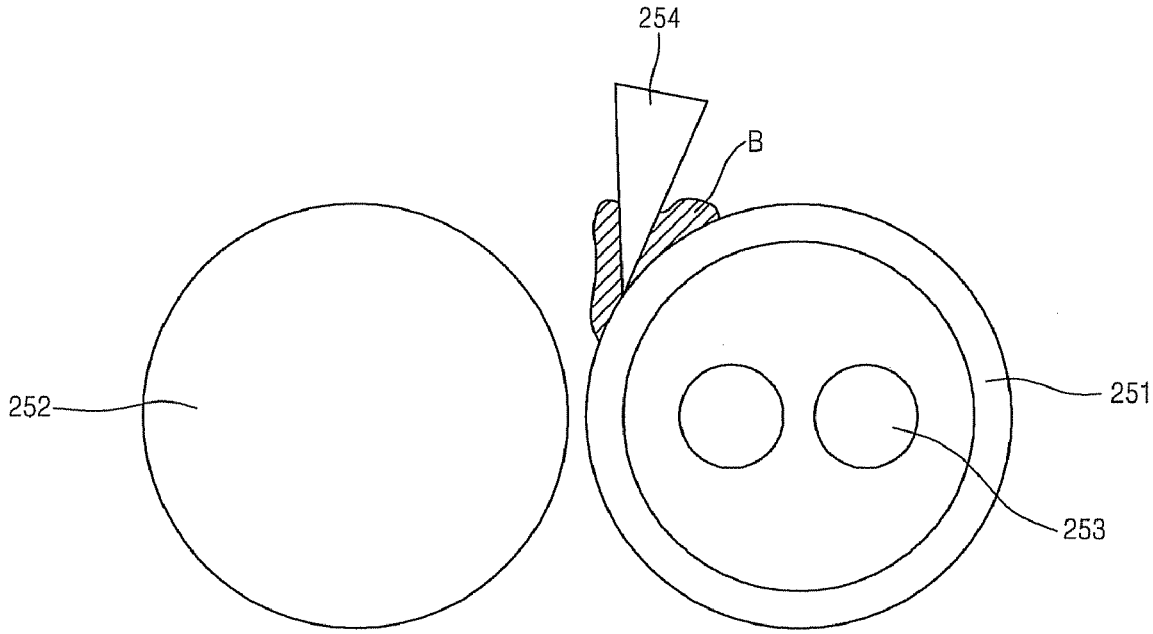
FIGS. 4A to 4D illustrate states of a fuser in the order in which the fuser is cleaned according to an embodiment of the present invention.

If the fuser is significantly contaminated as a result of the performance of a number of printing operations, it is necessary to perform a fuser cleaning operation to separate toner remnants B that may be fixed to a guide member 254 from the guide member 254 as shown in FIG. 4A. When a fuser cleaning mode has been set, the controller 201 controls operations of the first and second motors 281 and 282 and the heater 253 as shown in FIG. 3. Specifically, the controller 201 simultaneously turns the heater 253 and the first motor 281 on and turns the second motor 282 off. Accordingly, the heating roller 251 is heated by the heater 253 while the heating roller 251 is not in motion and a sheet of paper S is picked up and conveyed along the paper conveyance path P.

Figure 4B:
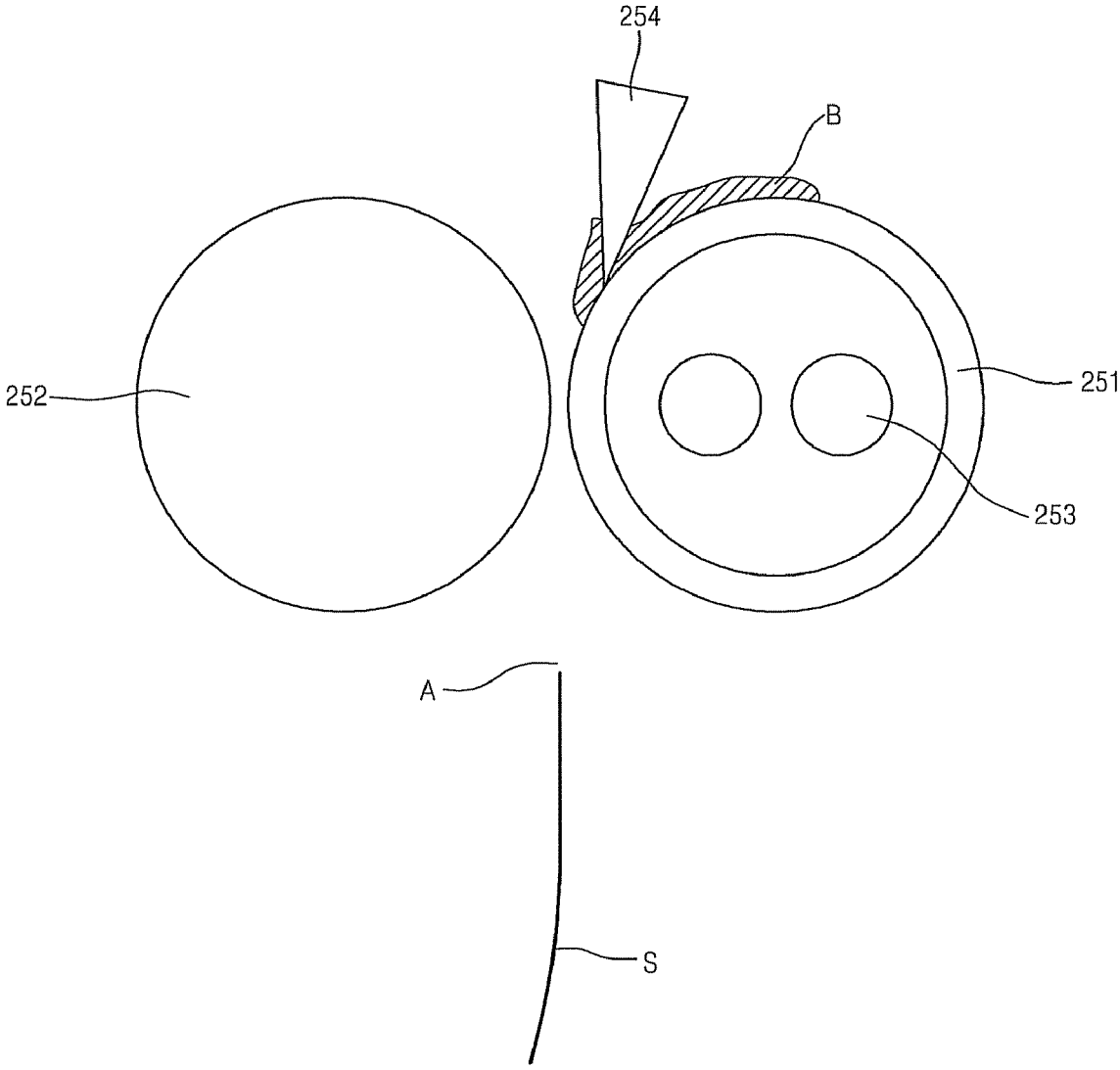
Figure 4C:
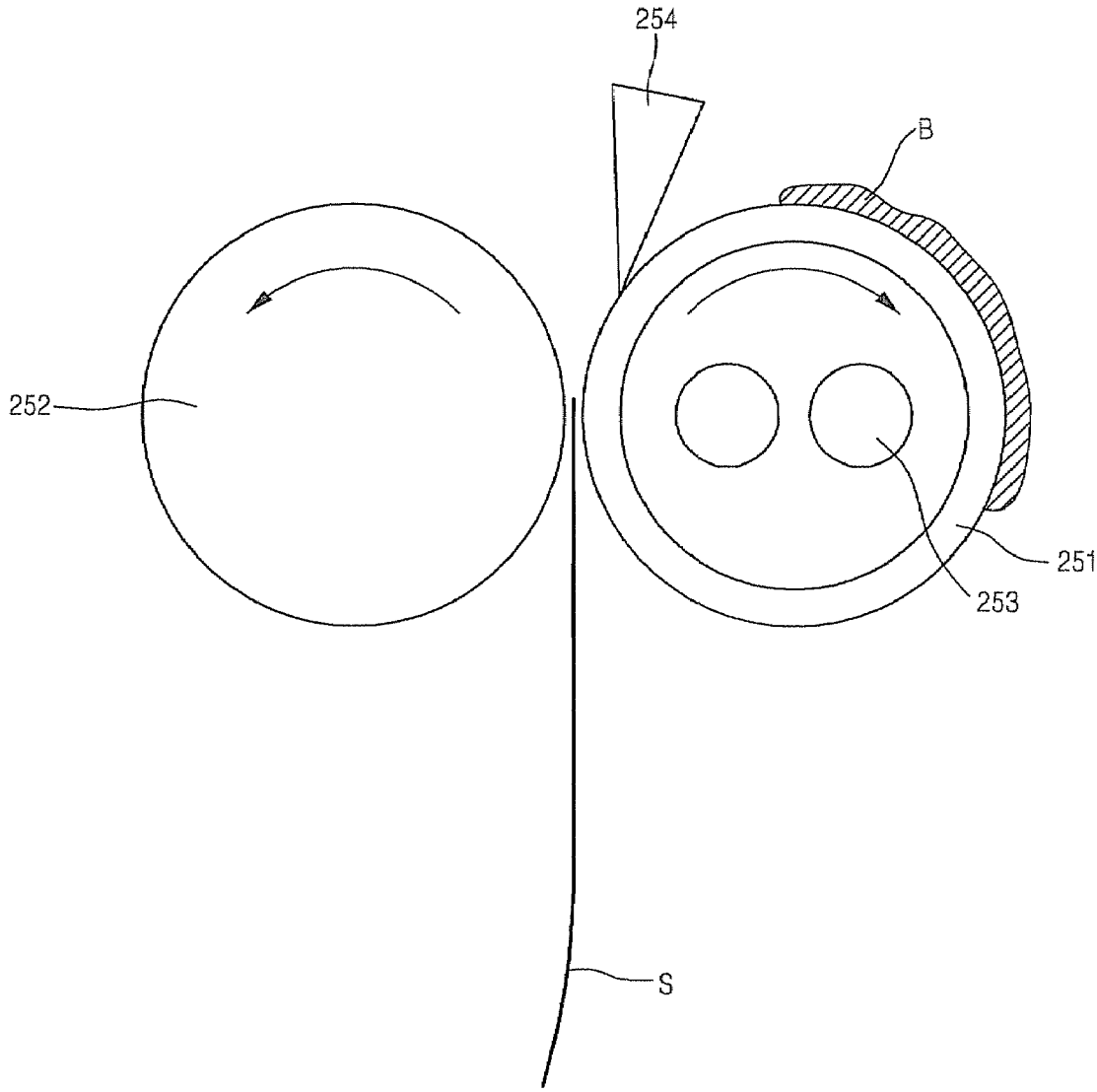
Figure 4D:
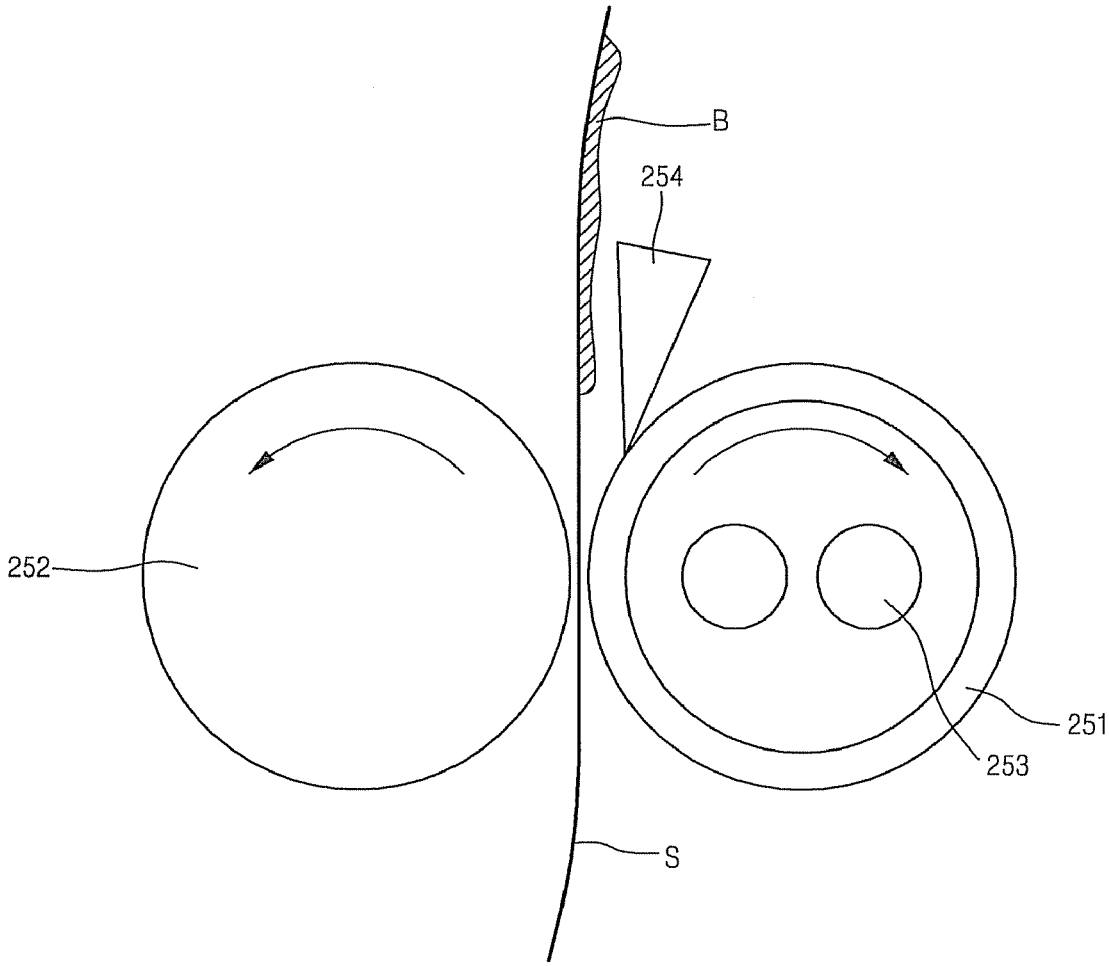

At time $T_a$ when the sheet of paper S reaches a specific position A, the controller 201 turns off the first motor 281 (see FIG. 4B). The temperature sensor 291 senses a temperature of the surface of the heating roller 251 and provides a signal indicating the sensed temperature to the controller 201. The controller 201 then determines whether the temperature sensed by the temperature sensor 291 has reached a preset temperature of the fuser cleaning mode. Here, according to an embodiment of the invention, the preset temperature of the fuser cleaning mode is the maximum allowable temperature that is equal to or greater than the temperature required to fuse toner when performing a printing operation in a normal printing mode. When the heating roller has been heated to the preset temperature, the controller 201 turns the heater 253 off and simultaneously turns both the first and second motors 281 and 282 on so as to introduce the sheet of paper S that is waiting at the specific position A into a gap between the heating roller 251 and the pressure roller 252 (see FIG. 4C).

Figure 5:
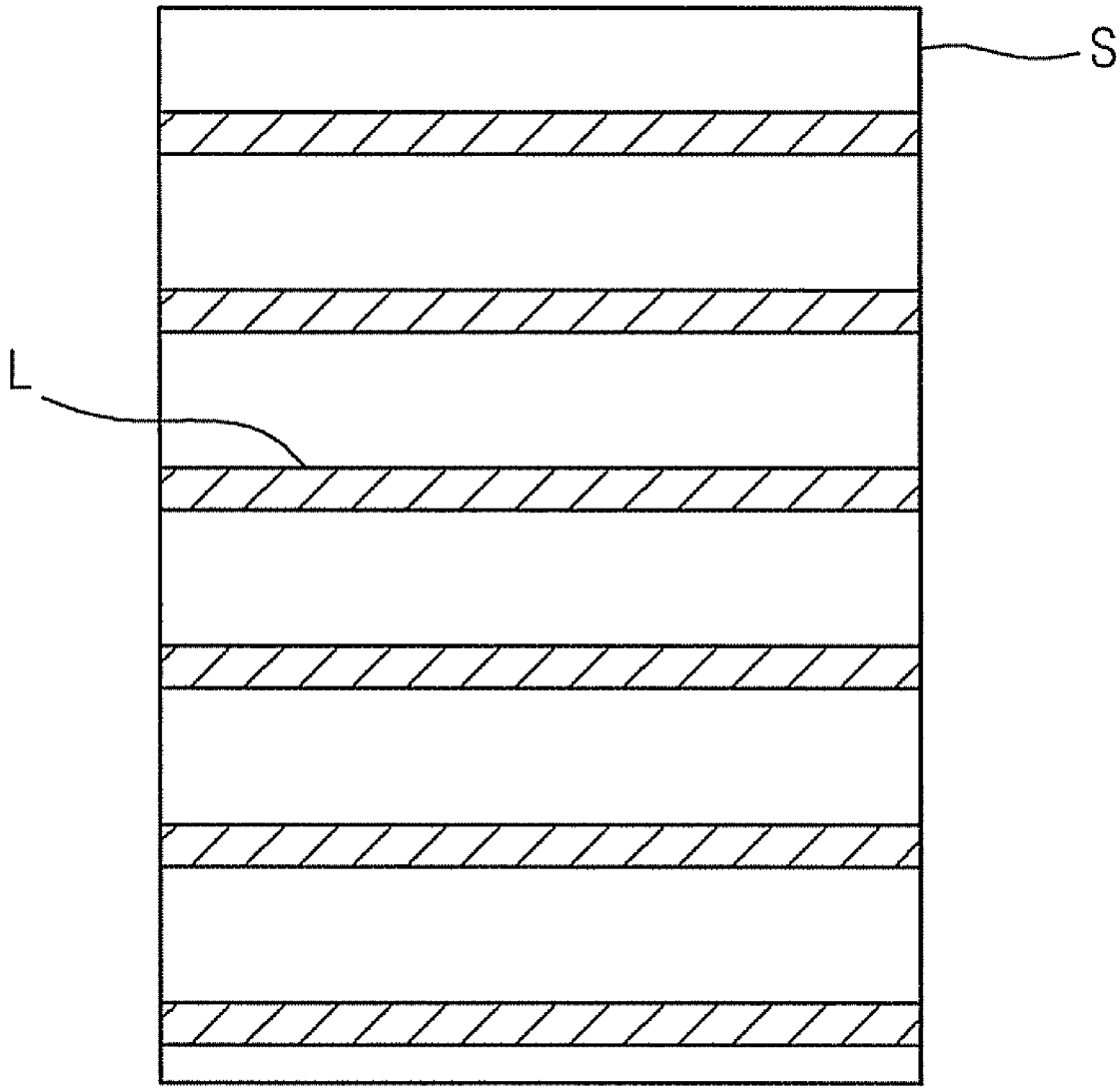
FIG. 5 illustrates a print medium, on which stripe images are developed at regular intervals to absorb and remove toner remnants of the fuser according to an embodiment of the present invention.

As the sheet of paper S passes between the heating roller 251 and the pressure roller 252, the paper S absorbs and removes toner remnants B that have been melted from the guide member 254 (see FIG. 4B). Here, it is possible to pass a sheet of paper S, on which toner images are developed in stripes L at regular intervals as shown in FIG. 5, between the heating roller 251 and the pressure roller 252, instead of passing a blank sheet of paper between them to increase the absorption efficiency of toner remnants.

According to an embodiment of the present invention, the controller 201 sets the fuser cleaning mode according to a cleaning mode setting command input from the host computer 100. According to an alternate embodiment, the controller 201 determines whether to set the fuser cleaning mode according to the number of printed sheets counted by the counter 202.

Figure 6:
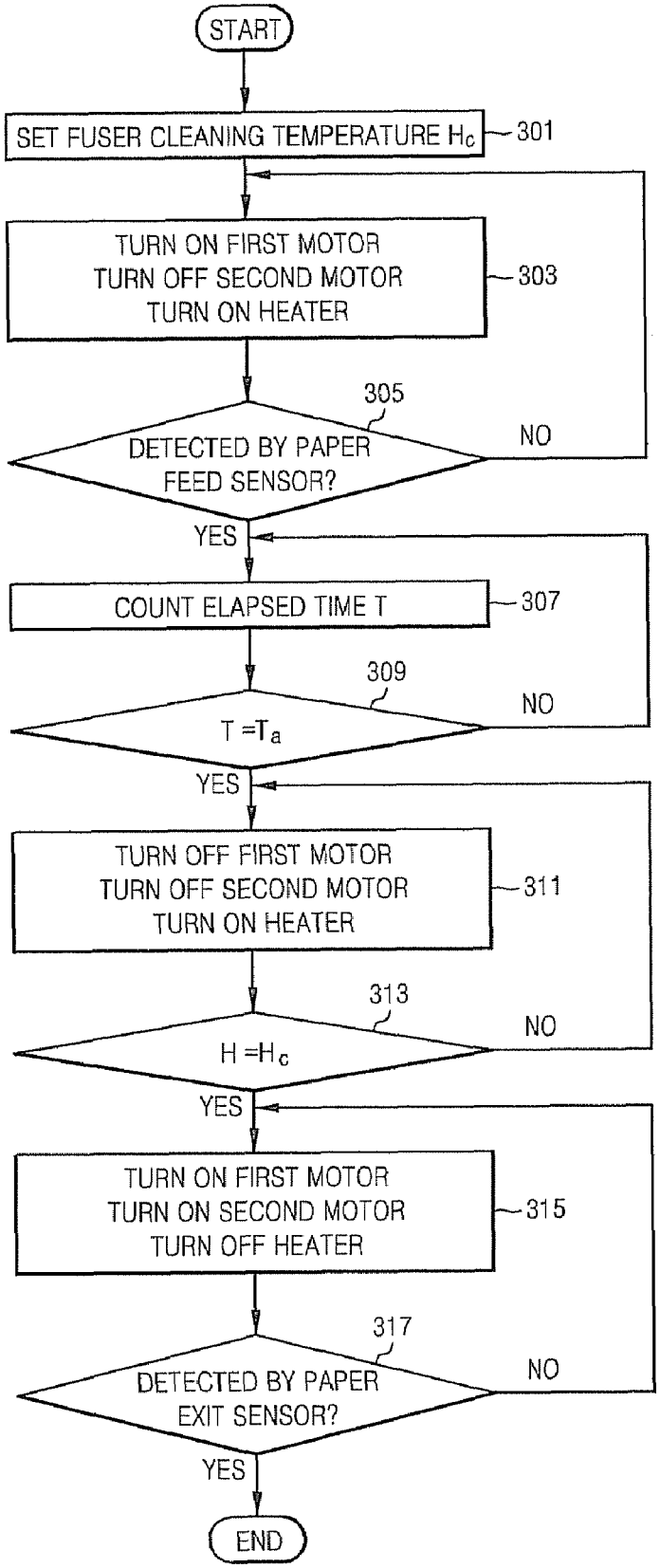
FIG. 6 is a flow chart illustrating a fuser cleaning method for an image forming device according to an embodiment of the present invention.

If the fuser cleaning mode is set, the controller 201 then performs a fuser cleaning operation to clean contaminants on the fuser as shown in FIG. 6.

First, the controller 201 sets a fuser cleaning temperature $H_c$ to be higher than a fusing temperature set to be appropriate for printing (301). The controller 201 turns the first motor 281 on, turns the second motor 282 off, and turns the heater 253 (303) on. Accordingly, the heating roller 251 is heated by the heater 253 while the heating roller 251 is not in motion and a sheet of paper S is picked up and conveyed along the paper conveyance path P.

While the sheet of paper S is conveyed, the controller 201 determines whether the sheet of paper S has been detected by the paper feed sensor 271 (305). If the sheet of paper S is determined to have been detected, the controller 201 counts an elapsed time T using an internal timer (307) and determines whether the counted time T has reached a preset time $T_a$. The preset time $T_a$ corresponds to the time required for the sheet of paper S to reach the specific position A from the paper feed sensor 271.

When the elapsed time T has reached the preset time $T_a$, the controller 201 determines whether a surface temperature H of the heating roller 251 sensed by the temperature sensor 291 has reached the preset cleaning temperature $H_c$ (313). If the surface temperature H is determined to have not reached the preset cleaning temperature $H_c$, the controller 201 returns to operation 311 to maintain the heating operation.

If the surface temperature H is determined to have reached the preset cleaning temperature $H_c$, the controller 201 turns the first and second motors 281 and 282 on and turns the heater 253 off (315). Accordingly, the sheet of paper introduced between the heating roller 251 and the pressure roller 252 absorbs and removes toner remnants on the guide member 254 that are melted from the guide member 254 by the heating of the heating roller 251.

The controller 201 then determines whether the sheet of paper has been detected by the paper exit sensor 272 (317). If the sheet of paper has not been determined to have been detected by the paper exit sensor 272, the controller 201 returns to operation 315 to maintain the cleaning operation so as to absorb and remove toner remnants from the paper guide memory 254.

If the determination of operation 317 is that the sheet of paper has been detected by the paper exit sensor 272, the controller 201 determines that the toner remnants absorption and removal operation has been completed and terminates the cleaning operation.

Although the first and second motors 281 and 282 are used as driving sources to drive the components in the above embodiments, according to another embodiment of the invention, the paper pickup, conveyance, development, transfer, fusing, and exit processes may be performed using a single motor.

Another embodiment of the invention is shown in FIGS. 7 to 10. According to this embodiment, a single motor performs a fuser cleaning operation and, as in the above embodiments, the heating roller is heated while it is not in motion to separate toner remnants fixed to the guide member from the guide member with a sheet of paper being passed between the heating roller and the pressure roller to clean the toner remnants.

Figure 7:
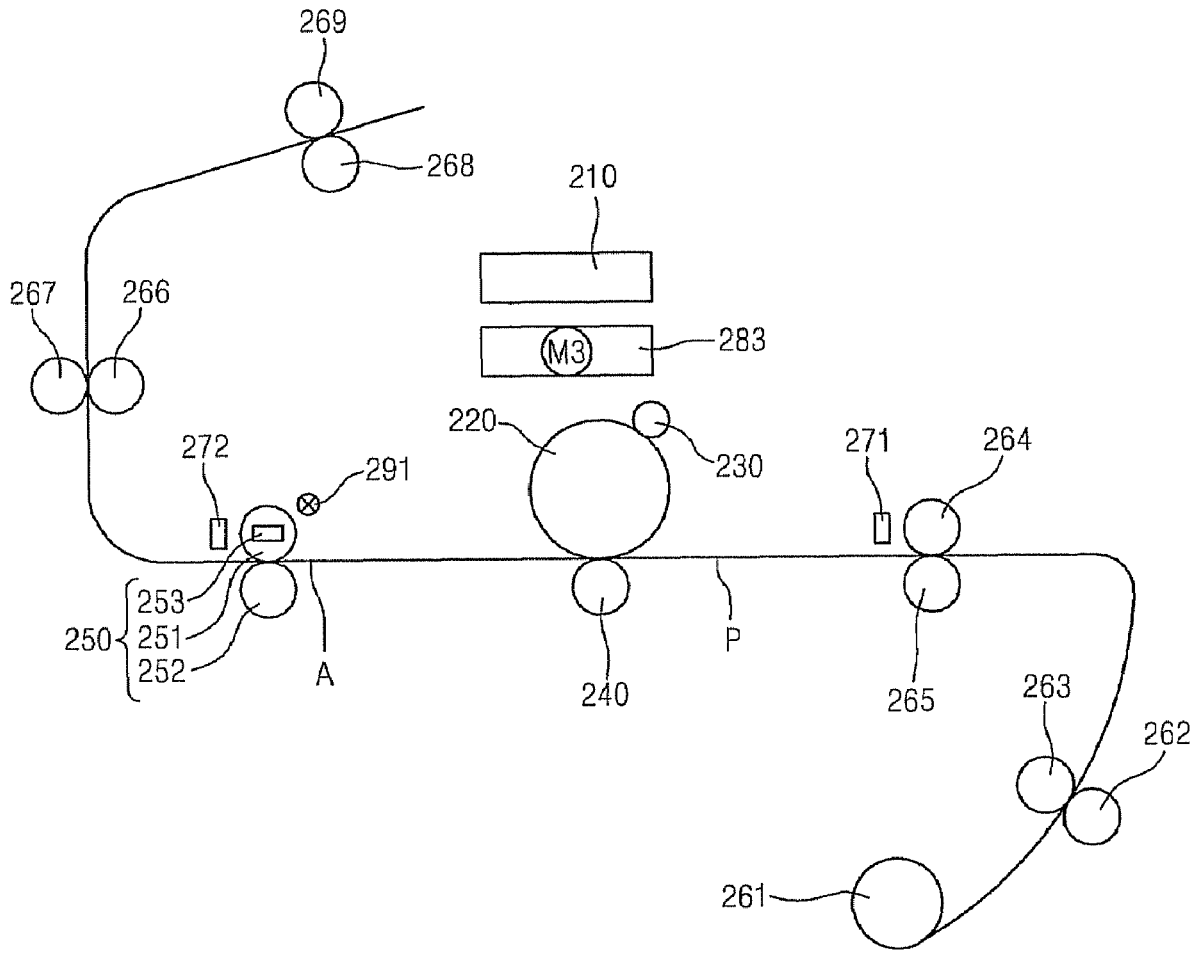
FIG. 7 is a schematic diagram illustrating a fuser cleaning apparatus for an image forming device according to another embodiment of the present invention.

As shown in FIG. 7, a fuser cleaning apparatus for an image forming device according to the present invention includes an integrated motor 283. The integrated motor 283 drives a photosensitive drum 220, a developing roller 230, a transfer roller 240, registration rollers 264 and 265, conveying rollers 262 and 263, a pickup roller 261, a heating roller 251, a pressure roller 252, and paper exit rollers 266, 267, 268, and 269 provided along a paper conveyance path P.

Figure 8:
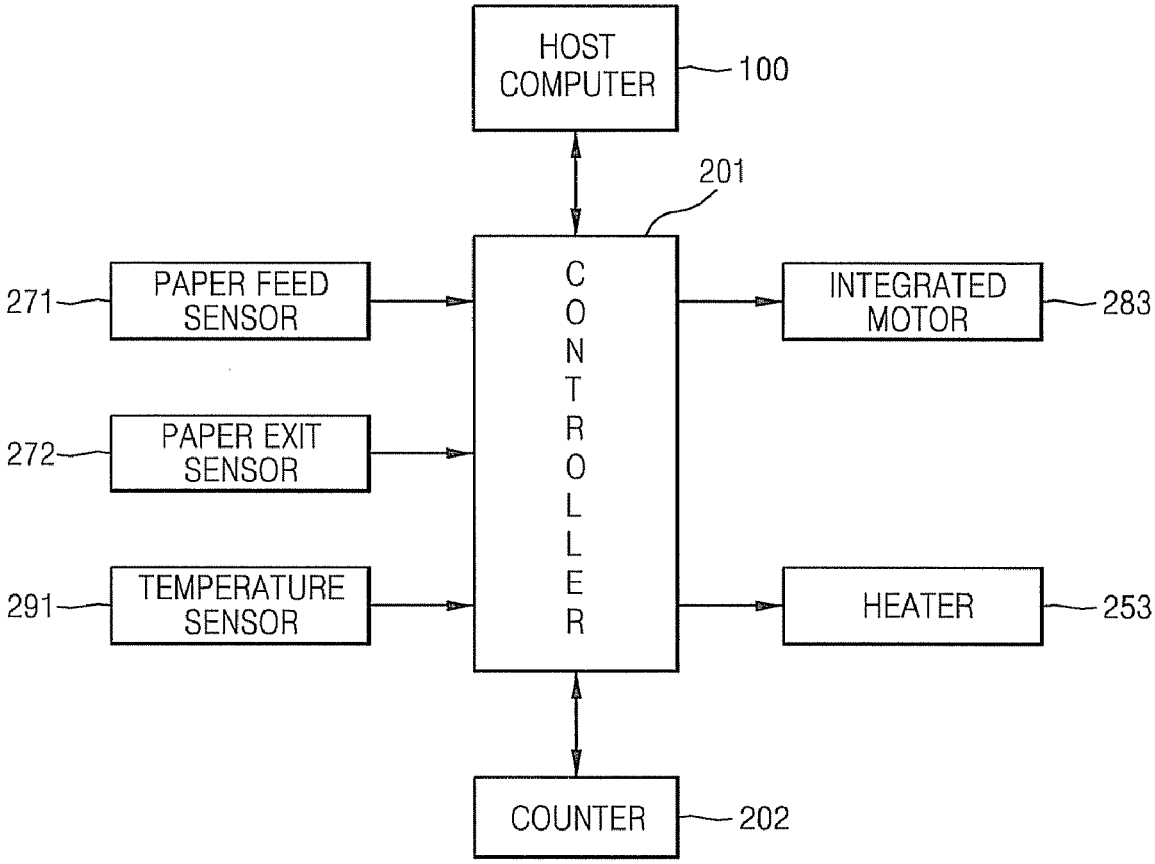
FIG. 8 is a control block diagram of a structure to control the cleaning apparatus of FIG. 7.
Figure 9:
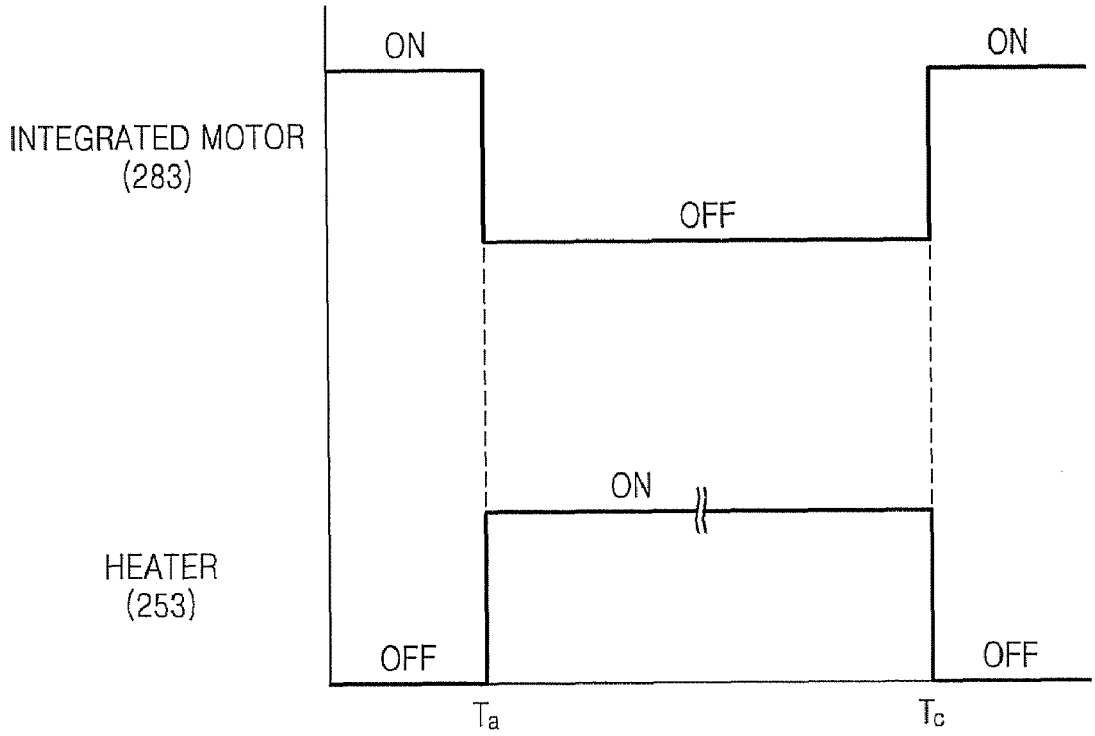
FIG. 9 illustrates operation control timings of an integrated motor and a heater when performing a fuser cleaning operation according to an embodiment of the present invention.

As shown in FIG. 8, the controller 201 sets a cleaning mode according to a fuser cleaning mode setting command from a host computer 100 or according to the total number of printed sheets to be counted by a counter 202. If the cleaning mode is set, the controller 201 controls operations of the integrated motor 283 and the heater 253 as shown in FIG. 9.

Figure 10:
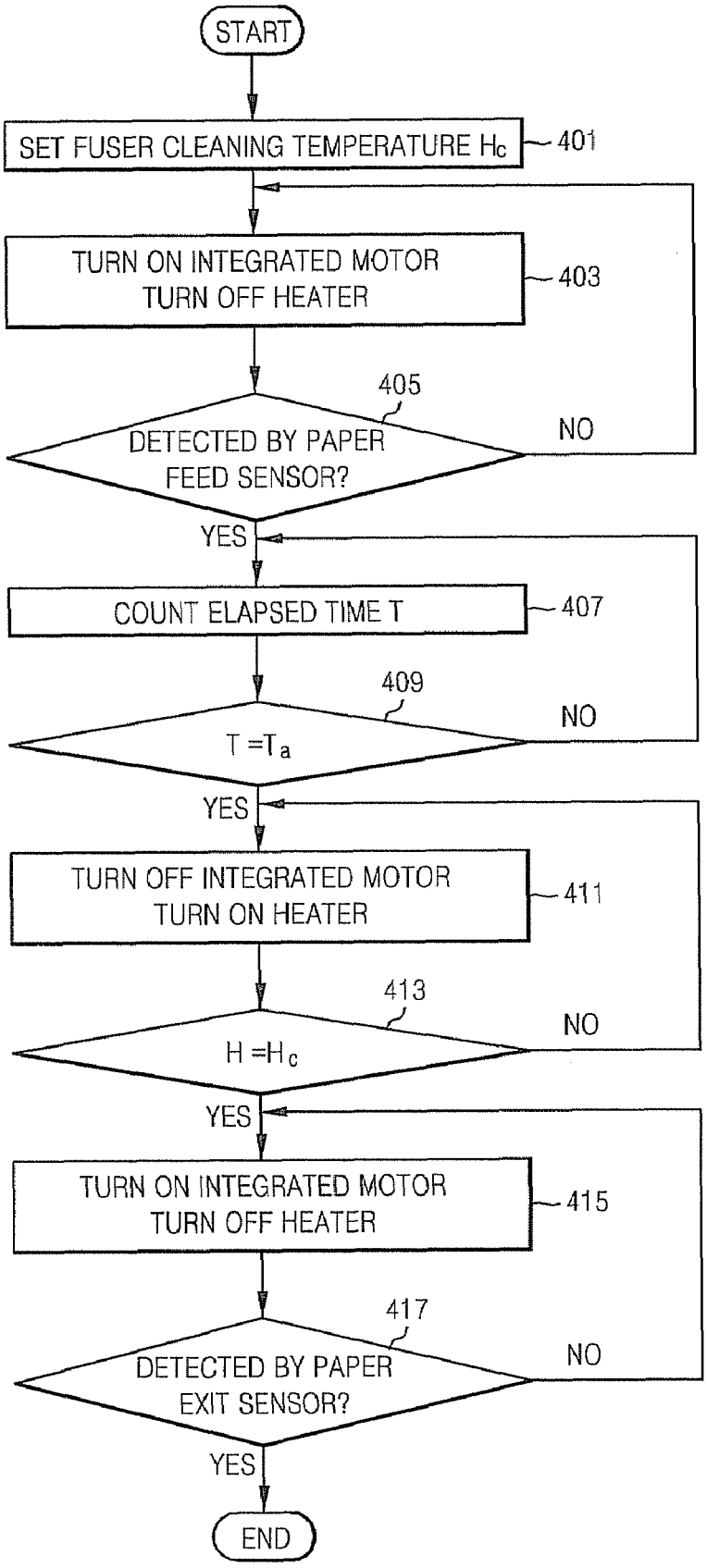
FIG. 10 is a flow chart illustrating a fuser cleaning method for an image forming device according to another embodiment of the present invention.

Reference will now be made to FIG. 10 which is a flow chart illustrating a fuser cleaning method for an image forming device. As shown in FIG. 10, first, the controller 201 sets a fuser cleaning temperature $H_c$ to be higher than a fusing temperature set for normal printing (401). The controller 201 turns the integrated motor 283 on and turns the heater 253 off (403). Then, a sheet of paper S is picked up and conveyed along the paper conveyance path P. Here, the integrated motor 283 rotates the heating roller 251 and the heater 253 is not in operation.

While the sheet of paper S is conveyed, the controller 201 determines whether the sheet of paper S has been detected by the paper feed sensor 271 (405). If the sheet of paper S has been determined to be detected, the controller 201 counts an elapsed time T using an internal timer (407) and determines whether the counted time T has reached a preset time $T_a$. The preset time $T_a$ corresponds to the time required for the sheet of paper S to reach the specific position A from the paper feed sensor 271.

When the elapsed time T has reached the preset time $T_a$, the controller 201 turns the integrated motor 283 off and turns the heater 253 on. Accordingly, the heating roller 251 is heated by the heater 253 while the heating roller 251 is not in motion and the sheet of paper S waits at the specific position A.

The controller 201 then determines whether a surface temperature H of the heating roller 251 that is sensed by the temperature sensor 291 has reached the preset cleaning temperature $H_c$ (413). If the surface temperature H is determined to have not reached the preset cleaning temperature $H_c$, the controller 201 returns to operation 411 to maintain the heating operation.

If the determination of operation 413 is that the surface temperature H has reached the preset cleaning temperature $H_c$, the controller 201 turns the integrated motor 283 on and turns the heater 253 off (415). Accordingly, the sheet of paper introduced between the heating roller 251 and the pressure roller 252 absorbs and removes toner remnants that are melted from the guide member 254 by heating of the heating roller 251.

The controller 201 then determines whether the sheet of paper has been detected by the paper exit sensor 272 (417). Depending on this determination, the controller 201 returns to operation 415 to maintain the cleaning operation or terminates the cleaning operation.

As is apparent from the above description, aspects of the present invention provide a fuser cleaning apparatus and method of operating a fuser cleaning apparatus for use with an image forming device which have a variety of advantages. For example, heat is efficiently transferred to a guide member of a fuser to allow for relatively easy performance of a cleaning operation of the fuser since a heating roller of the fuser is heated by a heater while the heating roller is not in motion. Also, it is possible to prevent melted toner remnants from contaminating the heating roller since a sheet of paper which has waited at an entrance of the fuser is conveyed and passed between the heating and pressure rollers of the fuser after the heating roller is heated while the heating roller is not in motion.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A fuser cleaning apparatus for use with an image forming device, the apparatus comprising:

a fuser including a guide member to guide a print medium conveyed through the image forming device, and heating and pressure rollers to fix an image to the print medium;

a power source to power the conveyance of the print medium and to rotate the fuser;

a heater to heat the heating roller to melt contaminants fixed to the guide member; and a controller to drive the heater while the fuser is not rotated and while the print medium is at the entrance of the fuser but not in contact with the fuser and to pass the print medium through the fuser to remove the melted contaminants from the guide member.

2. The fuser cleaning apparatus according to claim 1, wherein the power source comprises:

a first motor to convey the print medium; and a second motor to drive the heating roller of the fuser.

3. The fuser cleaning apparatus according to claim 2, wherein the controller simultaneously conveys the print medium to an entrance of the fuser using the first motor and heats the heating roller using the heater.

4. The fuser cleaning apparatus according to claim 3, further comprising a temperature sensor to sense a surface temperature of the heating roller.

5. The fuser cleaning apparatus according to claim 4, wherein, when the temperature sensed by the temperature sensor reaches a preset temperature, the controller stops the heating of the heat roller and drives the first and second motors to pass the print medium through the fuser.

6. The fuser cleaning apparatus according to claim 1, wherein the power source comprises an integrated motor to convey the print medium and to drive the heating roller of the fuser.

7. The fuser cleaning apparatus according to claim 6, wherein the controller conveys the print medium to a position, heats the heating roller, and after heating the heat roller to a preset temperature, causes the print medium to move between the heating roller and the pressure roller and absorb and remove contaminants at the position.

8. The fuser cleaning apparatus according to claim 1, wherein the apparatus is set to a cleaning mode when the controller detects that a total number of printed sheets of print media counted in printing operations reaches a preset number.

9. A fuser cleaning method for use with an image forming device comprising a fuser including a guide member and heating and pressure rollers to fix an image transferred to a print medium, the method comprising:

heating the fuser, when a cleaning mode for the fuser has been set, by driving a heater thereof while the print medium is at the entrance of the fuser but not in contact with the fuser and while the fuser does not rotate to melt contaminants on the guide member; and passing the print medium through the fuser to absorb and remove the melted contaminants.

10. The fuser cleaning method according to claim 9, wherein the image forming device further comprises a first motor to convey the print medium, a second motor to drive the heating roller of the fuser, and a temperature sensor to sense temperature of the heated fuser, wherein the print medium is conveyed to an entrance of the fuser using the first motor at the same time as the heating by the heater, the temperature sensed by the temperature sensor is compared with a preset temperature, and if the sensed temperature reaches the preset temperature, then the print medium is passed between the heating roller and the pressure roller of the fuser using the first and second motors.

11. The fuser cleaning method according to claim 9, wherein the image forming device further comprises an integrated motor to perform an operation to convey the print medium and an operation to drive the heating roller of the fuser and a temperature sensor to sense temperature of the heated fuser, wherein the print medium is conveyed to an entrance of the fuser using the integrated motor before the heating by the heater, the temperature sensed by the temperature sensor during the heating is compared with a preset temperature, and if the sensed temperature reaches the preset temperature, then the heating is stopped and the print medium is passed between the heating roller and the pressure roller of the fuser using the integrated motor.

12. The fuser cleaning method according to claim 9, wherein the cleaning mode is set when a total number of printed sheets of print media counted in printing operations reaches a preset number.

13. A method of operating a cleaning mode of a fuser of an image forming apparatus, comprising:

setting a fuser cleaning temperature;

activating a power source of the image forming apparatus to convey the print medium through the apparatus to a first position;

when the print medium reaches the predetermined position, deactivating the power source and activating a heater of the fuser to heat the fuser while the print medium is at the entrance of the fuser but not in contact with the fuser;

when the temperature of the fuser reaches the fuser cleaning temperature, reactivating the power source to convey the print medium to a second position and deactivating the heater; and when the print medium reaches the second position, ending the cleaning mode.

14. The method according to claim 13, wherein the fuser cleaning temperature is higher than a fixing temperature.

15. The method according to claim 13, wherein the cleaning mode is set when a total number of printed sheets of print media counted in printing operations reaches a preset number.

* * * * *